US006378440B1

(12) United States Patent
Rhodes

(10) Patent No.: US 6,378,440 B1
(45) Date of Patent: Apr. 30, 2002

(54) OVERHEAD CONVEYOR ROTATOR SYSTEM

(76) Inventor: Arthur B. Rhodes, 901 Bean Rd., Sellersburg, IN (US) 47172

( * ) Notice: Subject to any disclaimer, the term of this patent is extended or adjusted under 35 U.S.C. 154(b) by 0 days.

(21) Appl. No.: 09/799,370

(22) Filed: Mar. 5, 2001

Related U.S. Application Data

(60) Provisional application No. 60/195,939, filed on Apr. 10, 2000.

(51) Int. Cl.[7] ..... B61B 10/04

(52) U.S. Cl. ..... 104/172.2; 104/89; 104/91; 104/93; 104/172.3; 198/343.1; 198/343.2

(58) Field of Search ..... 104/89, 91, 93, 104/94, 106, 107, 111, 172.2, 172.3, 172.4; 198/683, 684, 465.1, 465.4, 343.1, 343.2, 803.2

(56) References Cited

U.S. PATENT DOCUMENTS 2,844,243 A * 7/1958 Christiansen et al. .... 104/172.2
2,965,043 A * 12/1960 Klamp et al. ..... 104/172.2
3,557,705 A * 1/1971 Gusse et al. ..... 104/172.3
3,829,175 A * 8/1974 Vogeli ..... 104/172.4
3,869,989 A * 3/1975 Pickstone ..... 104/94
3,874,304 A * 4/1975 Robert ..... 104/172.4
4,172,423 A * 10/1979 Monne ..... 104/94
4,438,702 A * 3/1984 Rhodes ..... 104/172.2
4,638,740 A * 1/1987 Rhodes ..... 104/172.2
4,770,285 A * 9/1988 Rhodes ..... 198/378
4,790,247 A * 12/1988 Summa ..... 104/172.2
4,944,228 A * 7/1990 Rhodes ..... 104/172.2
5,067,414 A * 11/1991 Moore et al. ..... 104/172.2
5,549,050 A * 8/1996 Rhodes ..... 104/172.2

* cited by examiner

*Primary Examiner*—S. Joseph Morano
*Assistant Examiner*—Lars A. Olson
(74) *Attorney, Agent, or Firm*—Charles G. Lamb; Middleton Reutlinger

(57) ABSTRACT

An overhead conveyor includes a rotator system for rotating a work piece as it travels along a conveying track. A carrier movable along the track is propelled by an endless conveyor chain disposed within said track. The carrier is detachably connected to the chain and includes an uncoupling assembly for detaching the carrier from the chain. A support post extends upwardly from an upper surface of the carrier and an upper portion of the support post is attached to an upper arm of a C-shaped load arm. The C-shaped load arm is provided with a lower arm having a rotatable platter attached thereto. A camming pin is fixedly attached to said platter and a camming assembly is affixed to an underside of the track wherein the track is provided with flanges to receive said camming pin. Upon engagement of the camming pin with the flanges of the track, the platter is rotated a preselected amount.

17 Claims, 8 Drawing Sheets

OVERHEAD CONVEYOR ROTATOR SYSTEM

CROSS-REFERENCE TO RELATED APPLICATION

This patent application claims the filing date of provisional patent application 60/195,939 filed Apr. 10, 2000.

BACKGROUND OF THE INVENTION

1. Field of the Invention

The present invention relates to an overhead conveyor rotator system, and more particularly to an overhead conveyor rotator system having at least one carrier moving within a track, wherein the carrier includes a rotating portion thereof which is engaged by a track-side g13 camming system thereby rotating the rotating portion through a preselected angle of rotation to include 90 degrees.

2. Description of Related Art

Conveying systems are typically used in manufacturing facilities to move work pieces through work stations, and from work station to work station, along a preselected path. There are a number of conveying systems for moving work pieces from work station to work station which include a conveyor moving at a preselected speed with carriers coupled for movement therewith between work stations and uncoupled from the conveyor so that they will be stationary at the work station while work is performed on a work piece carried by the load carrying units. Examples of patents directed to such conveying systems include U.S. Pat. No. 4,438,702; U.S. Pat. No. 4,644,869; U.S. Pat. No. 4,638,740; and, U.S. Pat. No. 4,770,285.

In general, and especially when a conveyor system utilizes curved track, consideration must be given to friction and associated increased loads placed upon propulsion machinery and load-bearing structures. Such load-bearing structures include rolling wheels and sliding chains. Current systems suffer from increased maintenance intervals and associated down-time for repair and replacement of worn parts. Current carriers are especially prone to frequent replacement of rolling structure, such as wheels and rollers due to rubbing, as such rolling structure travels along conveyor track and must navigate curves, inclines, and other high-friction areas.

Current uncoupling systems often require the use of sophisticated and expensive electronic detection and logic means. Mechanical means for accomplishing uncoupling are often unreliable, placing the work pieces moved about by the system at great risk of damage by inadvertent collision with other carriers. Additionally, if uncoupling is not highly predictable and highly reliable, work pieces can be left in a work area for either too long or too short a time, thereby resulting in undesirable results in work to be done, such as forming of surface contours, application of finishes, heating of finished surfaces, and the like.

Often times, best results can be obtained at a work station when a work piece is rotated through a preselected angle of rotation. Such rotation must also be highly predictable and highly reliable. Additionally, current rotation means often interfere with track construction, or require that special design consideration be given to including the track in a work station, yet insulating that same section of track from extreme heat, solvents, and the like.

Taken together, all the above described problems mitigate against a highly efficient conveyor means for automated movement of work pieces through work stations. Thus, there is a need for a conveyor rotator system which provides a carrier featuring reduced rubbing and other wear to rolling surfaces, makes good use of manufacturing floor space, provides for angular rotation of a work piece, and allows high reliability and efficiency in moving work pieces through work stations.

SUMMARY OF THE INVENTION

An object of the present invention is to provide a conveyor rotator system which includes a carrier which moves through a track with reduced rubbing and wear to its rolling components.

Another object of the present invention is to provide a conveyor rotator system which includes a hinged carrier to achieve reduced rubbing and wear to its rolling components.

A further object of the present invention is to provide a conveyor rotator system which includes a mechanically actuated uncoupling means.

Yet another object of the present invention is to provide a conveyor rotator system which includes a platter rotation means whereby a work piece is rotated through a preselected angle of rotation, thereby optimizing the utilization of manufacturing floor space.

More particularly, the present invention recognizes and addresses in a conveyor rotator system, the problems of frequent replacement of rolling structure such as wheels and rollers due to rubbing as such rolling structure travels along conveyor track and must navigate curves, inclines, and other high-friction areas; uncoupling which is not highly predictable and highly reliable; and, rotation of a work piece that is consistent in angular rotation desired and achieved while at the same time minimizing the contact of the conveyor system itself to include track and carrier, with the work stations.

Specifically, a conveyor rotator system is provided which includes:

- a T-shaped track with three U-shaped channels connected to form an enclosure with an open top and having straight, curved, inclined, and reclined sections;
- a propelling means, such as a chain, running along a chain channel of the track and connected to a propulsion source, such as a motor connected to a drive shaft having a cogged drive sprocket engaged to the chain;
- a carrier moving inside of the track and including:
  - a front and back section connected to a pivoting middle section and joined together by pivot pins;
  - wheels affixed to side and bottom surfaces of the sections;
  - an uncoupling assembly including a chain engaging pin and an uncoupling bar connected by associated linkage to the pin;
  - a support post extending from an upper surface of the carrier and protruding through the open top of the track;
  - a C-shaped load arm supporting a platter;
  - a camming pin affixed to the platter; and,
  - a camming assembly affixed to the track and having flanges to receive and guide the camming pin, thereby rotating the platter a preselected amount.

Further objects and advantages of this invention will appear from the following description and appended claims, reference being had to the accompanying drawings forming a part of the specification wherein like reference characters designate corresponding parts into several views.

BRIEF DESCRIPTION OF THE DRAWINGS

A better understanding of the invention will be had upon reference to the following description in conjunction with the accompanying drawings, wherein like numerals refer to like parts throughout the several views and wherein.

DETAILED DESCRIPTION OF THE PREFERRED EMBODIMENT

Figure 1:
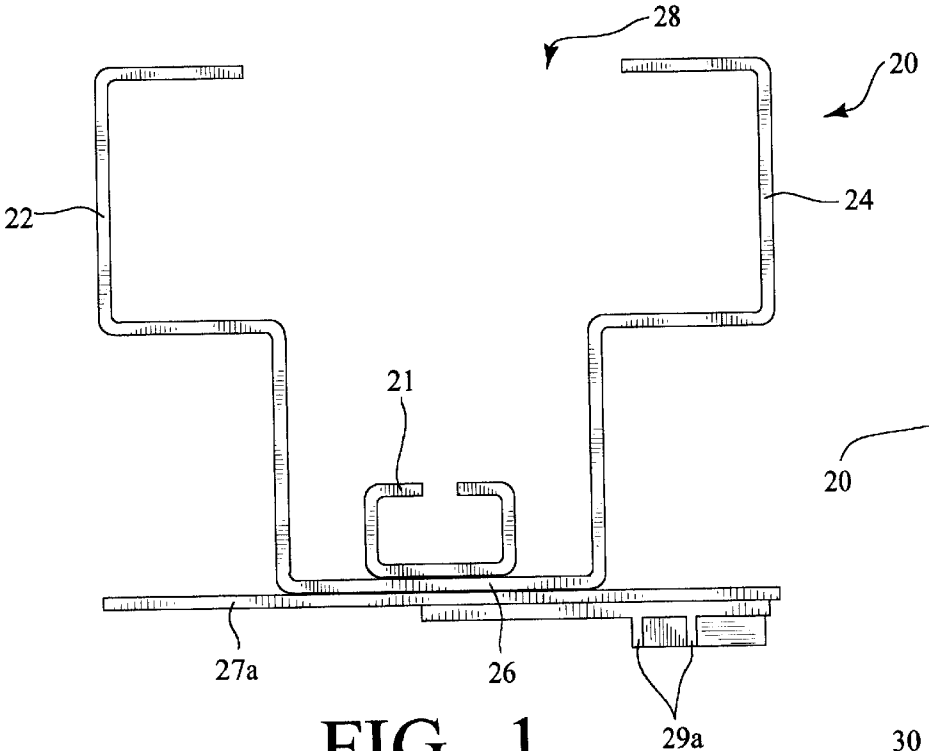
FIG. 1 is an end view of the track of the overhead conveyor rotator system of the present invention.

As shown in FIG. 1, a track 20 is of T-shaped configuration with three U-shaped channels connected to form an enclosure with an open top. The three U-shaped channels are identified by the numerals 22, 24, and 26. Open top 28 is defined by terminating channel ends of channels 22 and 24. The track 20 has straight, curved, inclined, and reclined sections, as desired, in order to route at least one work piece (not shown) mounted onto work piece support arm 110 (FIG. 2) through various preselected work stations (not shown). Camming assemblies 27*a* and 27*b* are affixed at selected locations to the underside of channel 26. A chain channel 21 is formed on an interior surface of channel 26 and along a route defined by the track 20. Multiple sections of track 20 are joined together by track flanges 23.

Figure 3:
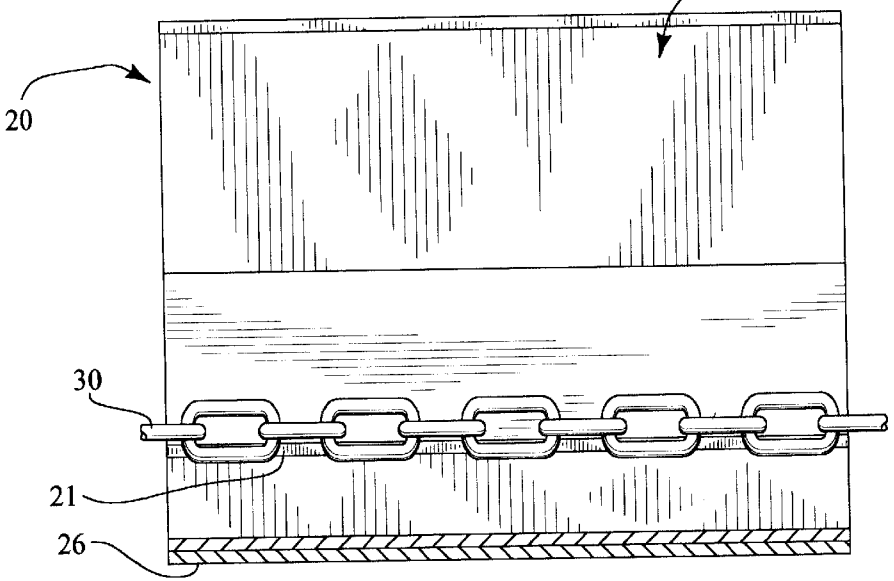
FIG. 3 is an enlarged cut-away sectional view of the track of the overhead conveyor rotator system of the present invention taken along lines 3—3 in FIG. 2.
Figure 2:
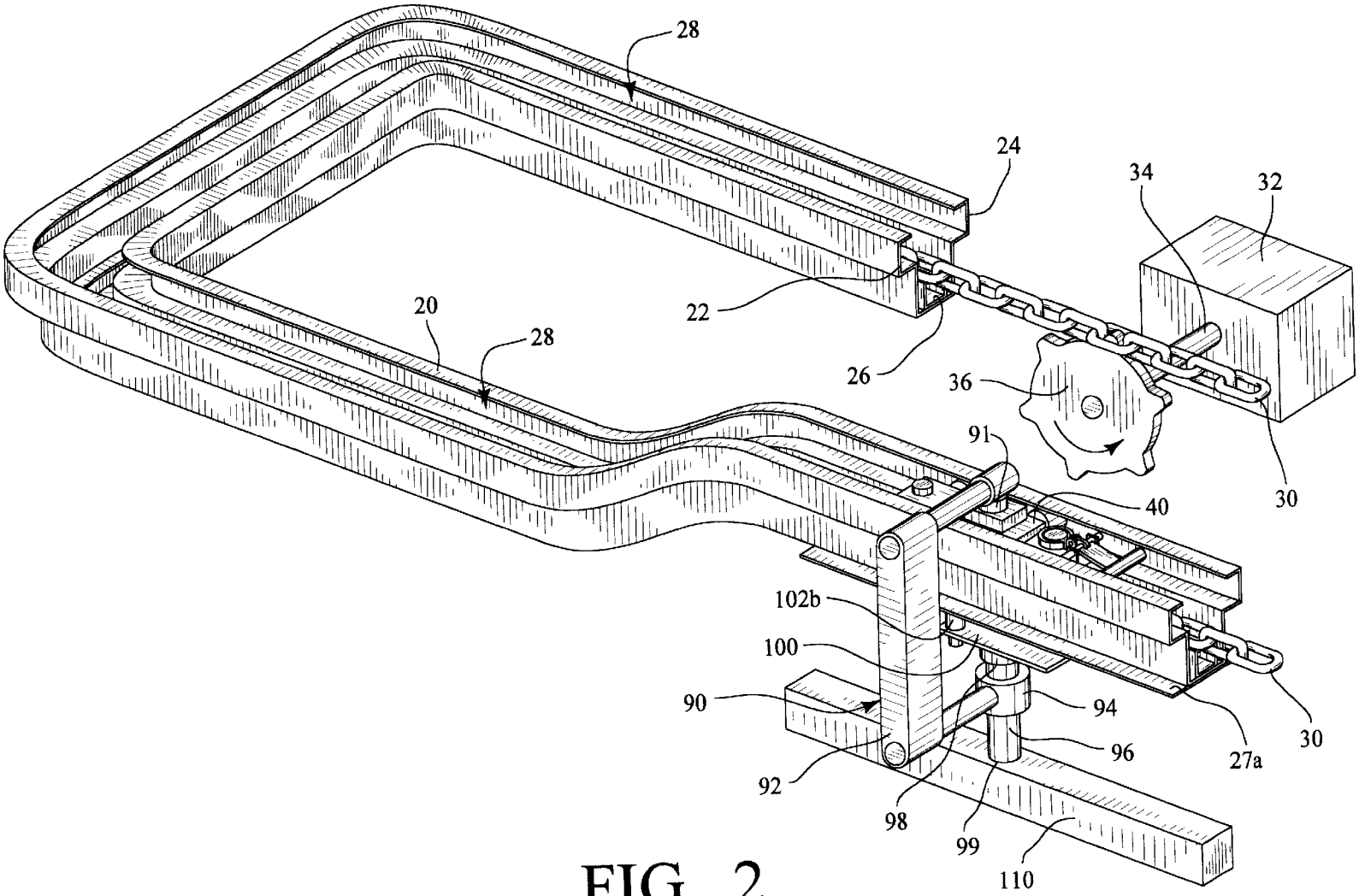
FIG. 2 is a perspective view of an overhead conveyor rotator system of the present invention.

As shown in FIGS. 2 and 3, a propelling means, such as, for example, a chain 30, rests upon and runs along the chain channel 21. The chain 30 is connected to a propulsion source, such as a motor 32 connected to a drive shaft 34 having a cogged drive sprocket 36 engaged to the chain 30.

Figure 4:
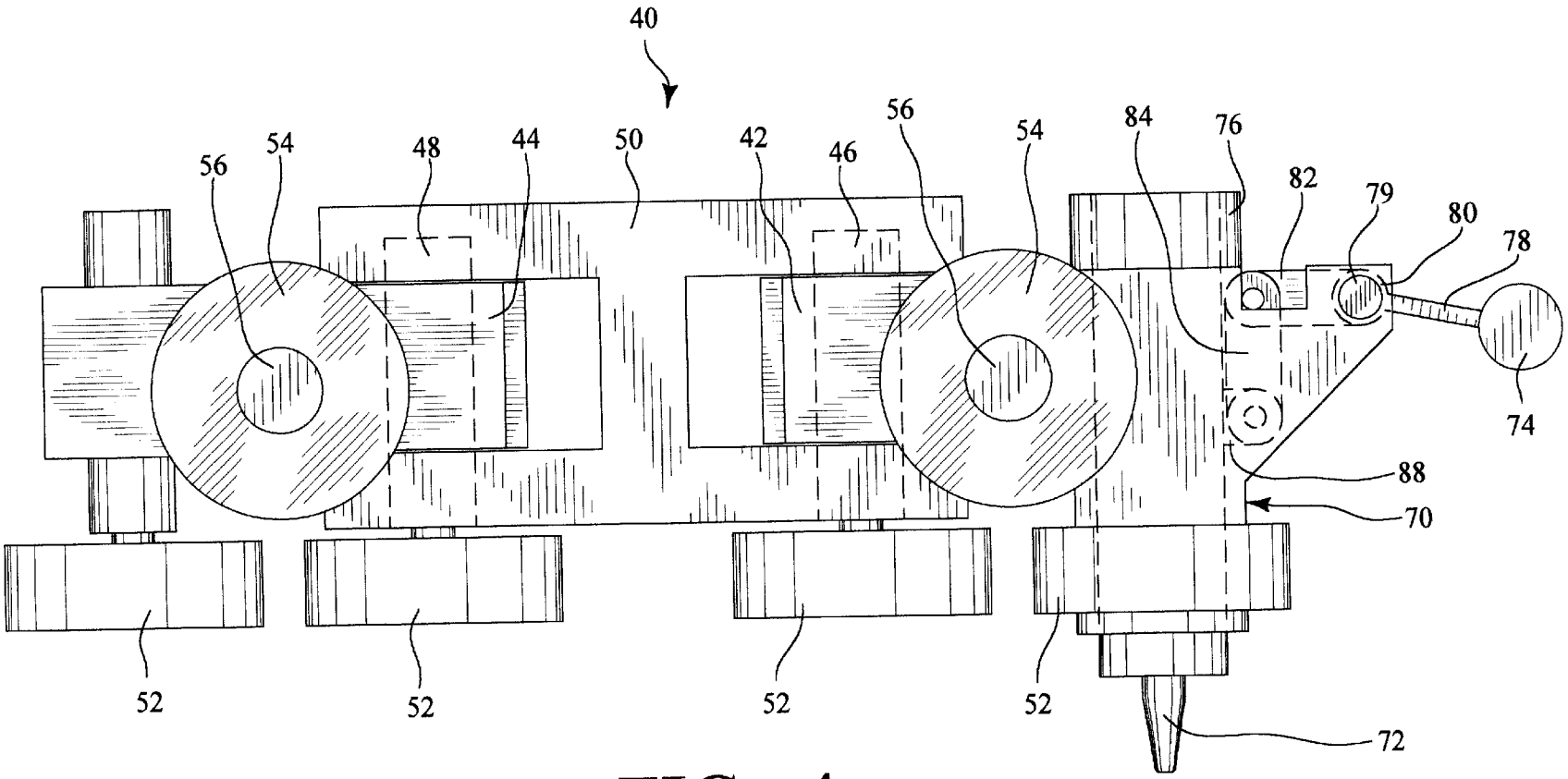
FIG. 4 is a side view of a carrier of the overhead conveyor rotator system with selected portions shown in phantom lines.
Figure 5:
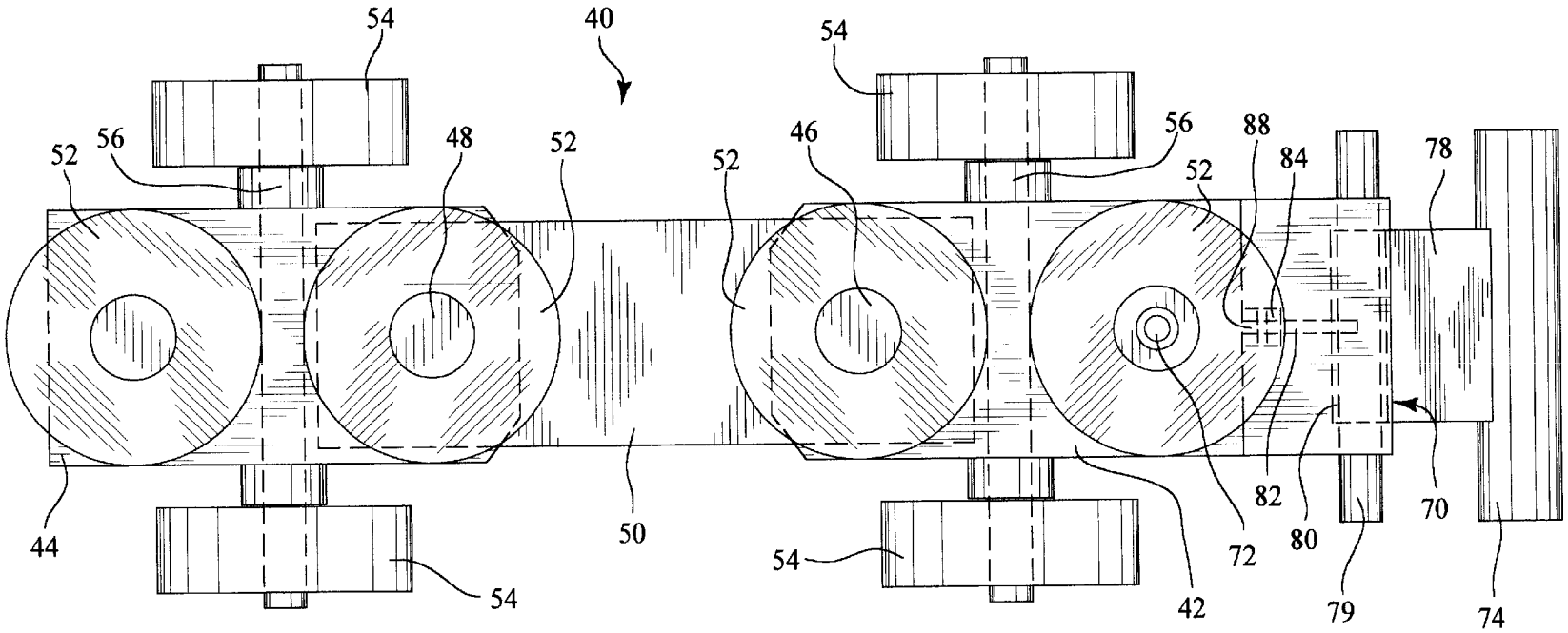
FIG. 5 is a bottom view of the load-carrying unit of FIG. 4 with selected portions shown in phantom lines.
Figure 6:
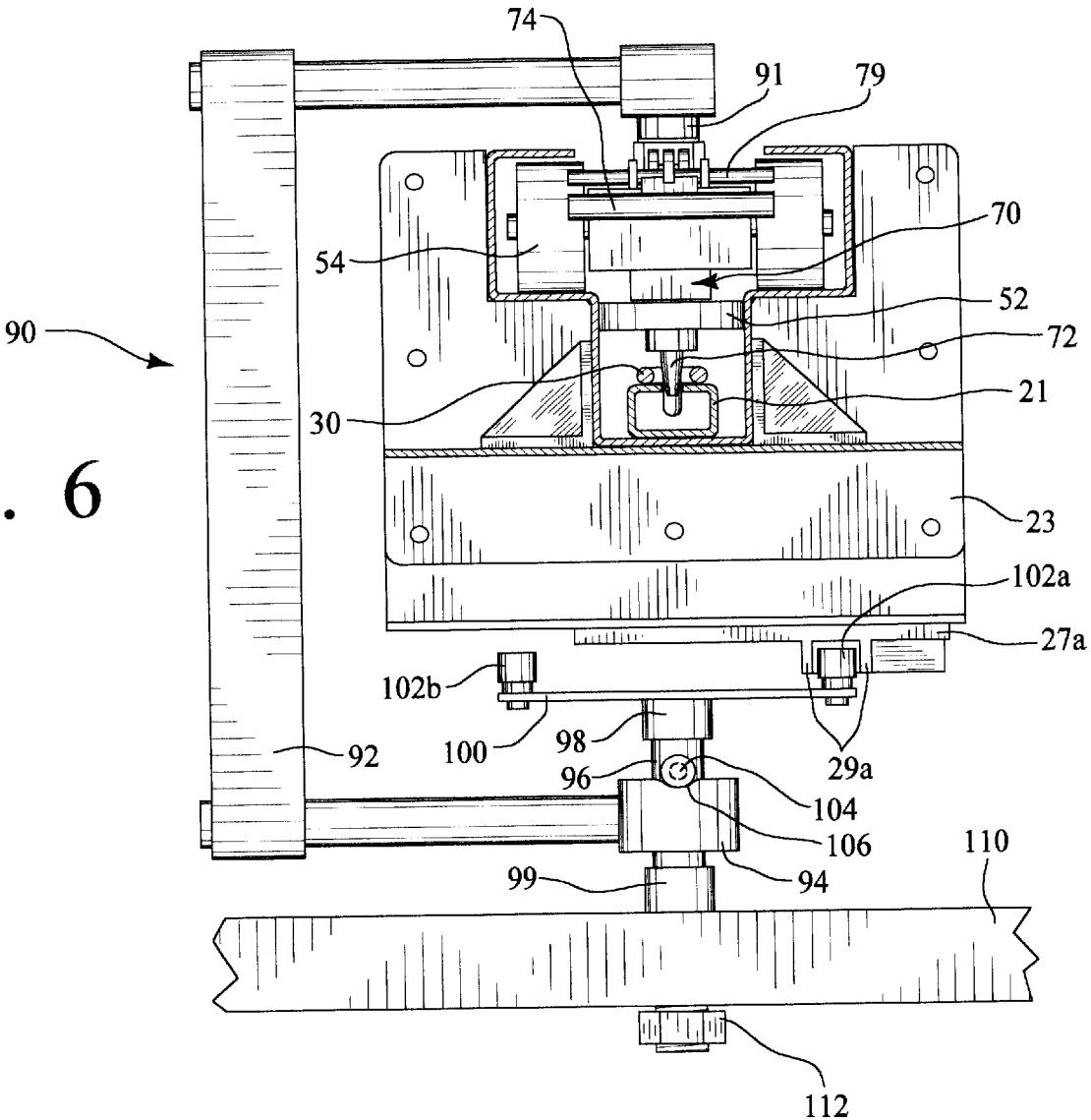
FIG. 6 is an end view of a conveying system of the present invention showing a work piece transverse to movement along a conveyor path.

As shown in FIGS. 4–6, a load carrying unit or carrier 40 is retained inside of track 20 and moves along a route defined by the track 20. The carrier 40 includes a front section 42 and a back section 44, both sections 42 and 44 connected to a pivoting middle section 50 by pivot pins 46 and 48, respectively. Four (4) Wheels 52 are affixed horizontally and located within channel 26, along an underside surface of the carrier 40 in order to guide and steer the carrier 40 along its conveying path in the track 20. Four (4) wheels 54 are vertically affixed in two pairs, one pair to each section 42 and 44 of the carrier 40. Each pair of wheels 54 is connected by axles 56 which pass through sides of each section. Wheels 54 are load bearing in that they support the combined weight of all structure attached to the carrier 40 as well as the weight of the work piece (not shown). Wheels 54 are located within channels 22 and 24 of the track 20.

Also provided is an uncoupling assembly 70 which includes a chain engaging pin 72 and a bumper or uncoupling bar 74 connected by associated linkage to the pin 72. The pin 72 is slidably mounted within a pin tube 76 which is mounted within front section 42 and oriented such that the pin 72 moves vertically, engaging and disengaging, as desired, within links of the chain 30. The uncoupling bar 74 is attached to a shaft 78 which extends rearward therefrom and is received within a sleeve 80 which is rotatably mounted within the front section and retained therein by a braking pivot pin 79 such that the bar 74 moves upwards and downwards, as desired, in order to cause vertical movement of the chain engaging pin 72. A lifting bar 82 is affixed to the braking pin 79 and connected to one end of a two-force linkage 84. The pin 72 has extending therefrom and through a corresponding slot formed in the pin tube 76, a lifting tab 88 to which the other end of the two-force linkage 84 is joined.

As shown in FIG. 6, a load bearing assembly 90 includes a support post 91 which extends from an upper surface of the carrier 40 and protrudes through the open top 28 of the track 20. In a preferred embodiment, a C-shaped load arm 92 is affixed at one end to the support post 91 and the other end receives a rotator tube 94 which is suspended below the track 20. A rotator shaft 96 having a first end 98 and a second end 99 is rotatably mounted within the rotator tube 94. A platter 100 is affixed to the first end 98 of the rotator shaft 96 and positioned above rotator tube 94 and below the camming assembly 27 of the track 20. At least one camming pin, two being shown and identified as pins 102*a* and 102*b*, is affixed to the platter 100 and oriented upwards. Pins 102*a* and 102*b* are slidably received and guided in sliding motion by flanges 29*a* and 29*b* of the camming assemblies 27*a* and 27*b* (FIG. 7C), respectively. A work piece support arm 110 receives a work piece (not shown) and is affixed to the second end 99 of the rotator shaft 96 by a nut 112 which engages corresponding threads (not shown). The work piece support arm 110 thereby serves, along with the platter 100, to retain the rotator shaft 96 within the rotator tube 94. At least one indexing roller 104 is affixed to the rotator shaft 96. The roller 104 correspondingly engages at least one indexing recess 106 formed along an upper surface of the rotator 94. Recesses 106 are preferably formed circumferentially around the upper surface of the rotator 94 and spaced 90° apart. However, other angular spacings, such as, for example, every 45° are provided as desired.

Figure 7B:
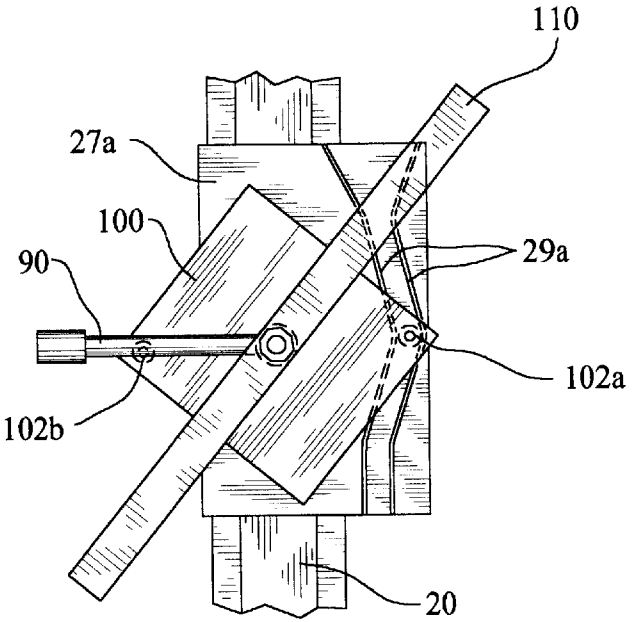
FIGS. 7A, 7B, and 7C show the sequence of events in turning a work piece from a first conveying position to the conveying path to a second conveying position with selected portions shown in phantom lines; and, FIGS. 8A, 8B, and BC show the sequence of events in stopping a carrier with selected portions shown in phantom lines and other sections shown in cut-away.
Figure 7A:
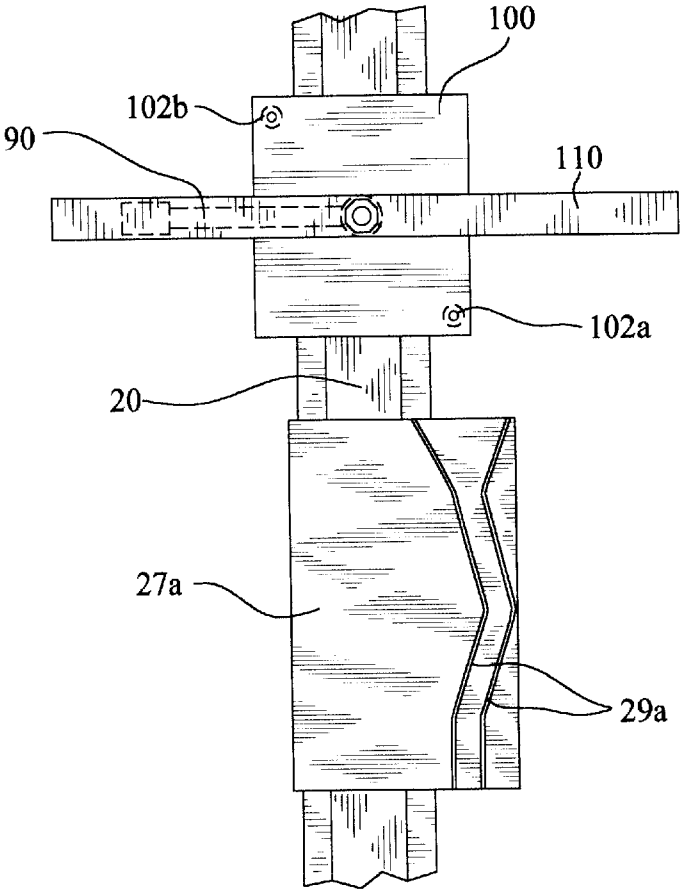
Figure 7C:
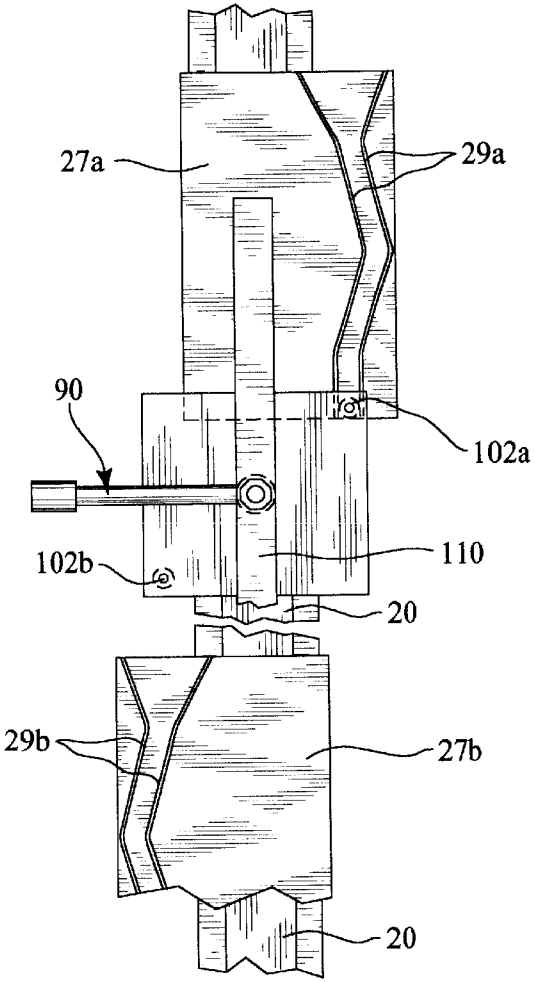

As shown in FIGS. 7A, 7B, and 7C, the camming assembly 27*a* is affixed to the track 20. Flanges 29*a* are spaced in parallel to receive and guide a camming pin 102*a*, thereby rotating the platter 100 and the work piece support arm 110 through a preselected amount of rotation, preferably 90°. Moreover, as shown in FIG. 7C, a second camming assembly 27*b* is provided with flanges 29*b* to receive camming pin 102*b*, also rotating the platter 100 and work piece through a preselected amount of rotation, again preferably 90°, thereby re-aligning the work piece to its original orientation.

Figure 8A:
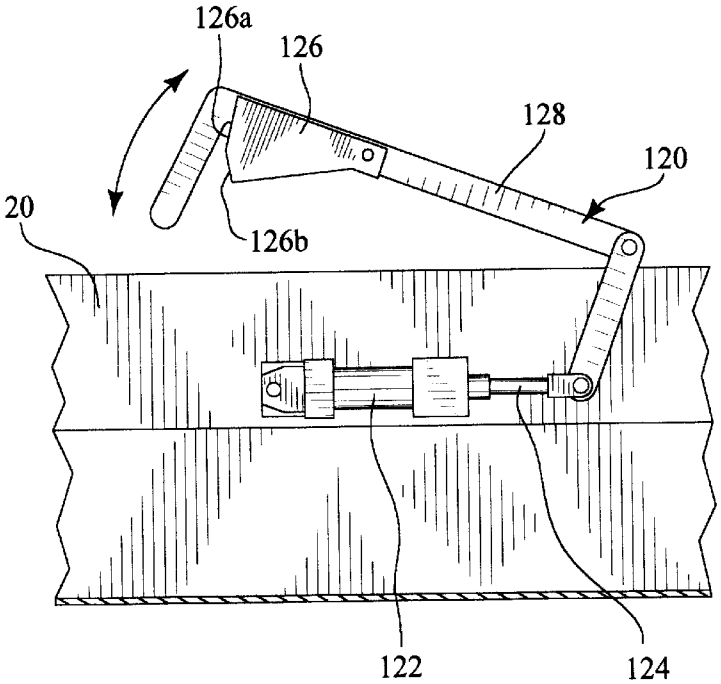
Figure 8C:
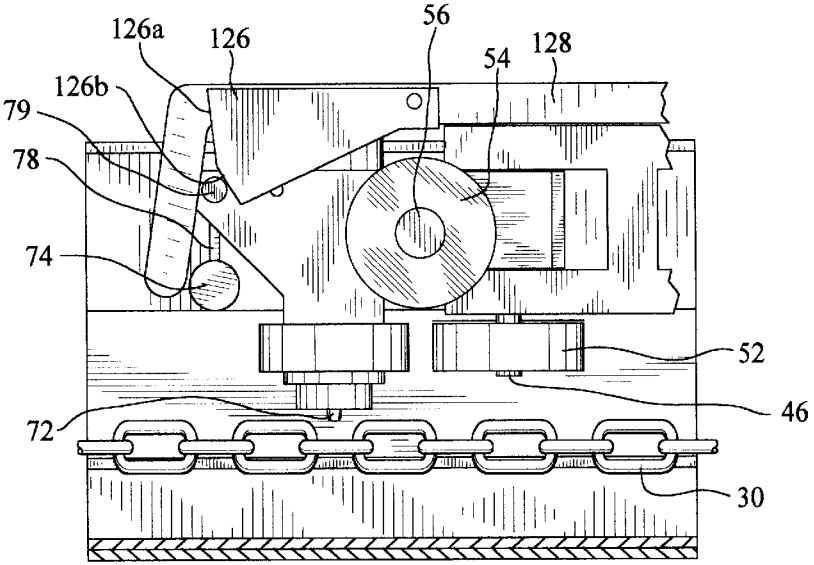
Figure 8B:
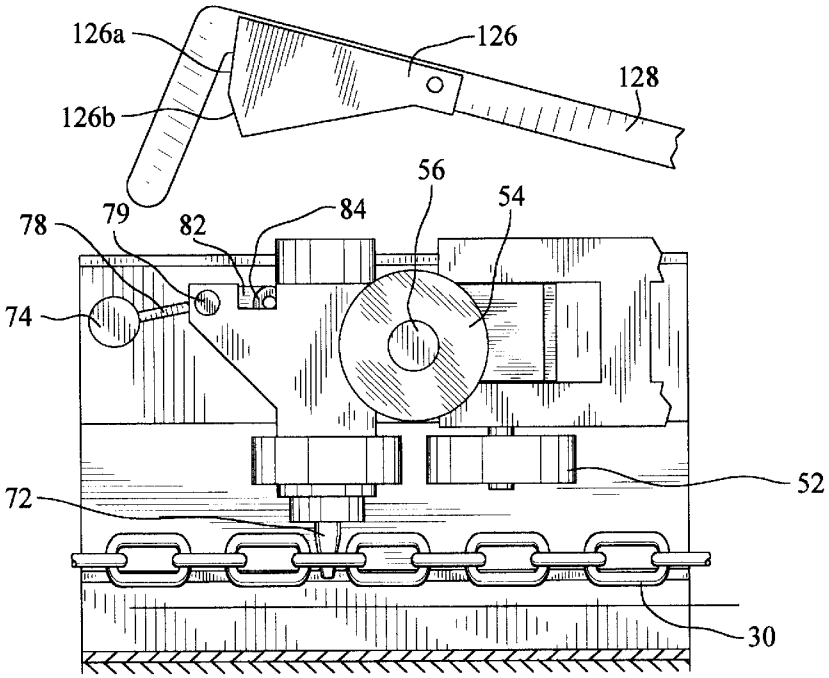

As shown in FIGS. 8A, 8B and 8C, a braking assembly 120 is shown. Braking assembly 120 includes a hydraulic or pneumatic piston cylinder 122, a piston rod 124, an uncoupler actuator 126, and a braking lever 128. The braking assembly is affixed to a channel 22 or 24 of the track, as desired, and oriented thereupon such that when stopping of a carrier 40 is desired, the braking lever 128 rotatably extends down through opening 28 of the track 20 and correspondingly blocks passage of the uncoupling bar 74. Stopping occurs as the carrier 40 moves past the braking assembly 120, and the braking lever 128 is lowered by the cylinder 122 and rod 124. Upon moving into contact with the braking lever 128, the uncoupling bar 74 engages the uncoupler actuator 126, thereby lowering the bar 74 whereby the pin 72 is raised, disconnecting the carrier 40 from the chain 30. The carrier 40 is held in place and prevented from moving forwards by the braking lever 128, and from moving backwards by the uncoupler actuator 126. Particularly, the uncoupler actuator 126 is of a geometric configuration to include a spacing between a terminating edge 126*a* and the braking lever 128. Moreover, the terminating edge 126*a* has a leading edge 126*b* which, as shown in FIG. 8C, engages pin 79 and in cooperating relation with braking lever 128 wedges pin 79 therebetween in a non-rotatable condition thereby preventing chain engaging pin 72 from engagement with the chain 30 until the braking lever 128 is raised.

In operation, a preferred overhead conveyor rotator system 10 operates as follows:

1. The work piece (not shown) is suspended from the work piece support arm 110.

2. The motor is energized, thereby causing the chain 30 to move within the track 20.

3. The carrier 40 moves along with the chain 30, the pin 72 being in the down position.

4. When rotation of a work piece is desired at a particular work station (not shown), the camming assembly 27*a* or 27*b* is utilized. As shown in FIGS. 7A, 7B, and 7C, the camming assembly 27*a* affixed to track 20 and having flanges 29*a*, receives and guides a camming pin 102A, thereby rotating the platter 100 and the work piece support arm 110 through a preselected amount of rotation, preferably 90°.

5. Whenever stopping a carrier 40 is desired, the uncoupling assembly 70 in cooperation with a braking assembly 120 is utilized. As shown in FIGS. 8A, 8*b* and 8C, stopping occurs as the carrier 40 moves past the braking assembly 120, and the braking lever 128 is lowered by the cylinder 122 and rod 124. Upon moving into contact with the braking lever 128, the bar 74 engages the uncoupler actuator 126, thereby lowering the bar 74 whereby the pin 72 is raised, disconnecting the carrier 40 from the chain 30. The carrier 40 is held in place and prevented from moving forwards by the braking lever 128, and from moving backwards by the uncoupler actuator 126.

6. When a carrier 40 is to be allowed to proceed from a stopped position, the braking lever 128 is raised by the cylinder 122 and rod 124, and the pin 72 is lowered back into engaging relation with the chain 30 and the carrier 40 moves along the track 20 once more.

Preferred embodiments allow the use of more than one track section 20 having chains 30 moving at different speeds, but abutting one another in series. Each track section 20 has its own continuous loop of chain 30, motor 32, etc. In this fashion, for example, a work piece (not shown) is allowed to progress at 21 feet per second in one track section 20, and then slowed to 7 feet per second in a second track section 20. A braking assembly 120 is inserted directly between the abutting track sections 20. A carrier 40 is advanced forward to the second track section 20 by a known carrier 40 or load carrying units advancing means. This feature allows stacking of work pieces (not shown) between track sections 20. When combined with the rotating features of the present invention, optimal use of space is achieved in storing and moving often times long and unwieldy work pieces (not shown) such as, for example, bed head boards, and the like.

The foregoing description is given primarily for clearness of understanding and no unnecessary limitations are to be understood therefrom for modifications will become obvious to those skilled in the art upon reading this disclosure and may be made without departing from the spirit of invention or scope of the appended claims.

What is claimed is:

1. An overhead rotator conveying system comprising:

a conveying track;

a carrier movable along said conveying track;

an endless conveyor chain disposed within said track, said carrier being detachably connected to said chain;

said carrier including an uncoupling assembly for detaching said carrier from said chain;

a support post extending vertically upwards from an upper surface of said carrier;

a C-shaped load arm having an upper end attached to an upper end of said support post;

a platter attached to a lower end of said load arm;

a camming pin fixedly attached to said platter; and, a camming assembly affixed to an underside of said track, said track having flanges to receive and guide said camming pin whereby said platter is rotated a preselected amount during engagement of said camming pin with said flanges of said camming assembly.

2. The system of claim 1, said chain being disposed along a bottom of said track.

3. The system of claim 1, said track being of T-shaped configuration.

4. The system of claim 3, said track being formed of three U-shaped channels defining an enclosure with an open top.

5. The system of claim 4, said support post extending through said open top of said track.

6. The system of claim 1, said track having straight, curved, inclined and reclined sections.

7. The system of claim 1, said carrier having three sections, a front section, a back section and a middle section, said front section being pivotally attached to a front of said middle section and said back section being pivotally attached to a back of said middle section.

8. The system of claim 7 including vertically aligned wheels attached on opposite sides of said carrier and horizontally aligned wheels attached along a bottom of said front, back and middle sections.

9. The system of claim 1, said uncoupling assembly including a chain engaging pin and an uncoupling bar in co-operating relation with said pin.

10. The system of claim 1, said upper end of said load arm being a first terminating end and said lower end of said load arm being a second terminating end.

11. The system of claim 1, said camming pin being attached at a preselected point along an outer periphery of said platter.

12. The system of claim 1, said camming pin and said camming assembly cooperating to rotate said platter about 90°.

13. A carrier for a conveyor system comprising;

a front section, a back section, and a middle section, said front section being pivotally attached to a front of said middle section and said back section being pivotally attached to a back of said middle section; and, an uncoupling assembly mounted onto said front section, said uncoupling assembly including a chain engaging pin in linkage connection through a braking pivot pin with an uncoupling bar whereby upon down movement of said bar causes vertical movement of said chain engaging pin.

14. The carrier of claim 13 including vertically aligned wheels attached on opposite sides of said carrier and horizontally aligned wheels attached along a bottom of said front, back and middle sections.

15. A carrier and a braking assembly for the carrier comprising:

(a) a carrier for mounting onto a chain driven conveyor;

(b) an uncoupling assembly mounted onto one end of said carrier, said uncoupling assembly including a chain engaging pin in linkage connection through a braking pivot pin with an uncoupling bar whereby upon down movement of said bar causes vertical movement of said chain engaging pin;

(c) a braking assembly for mounting onto said chain driven conveyor, said braking assembly including a braking lever attached to a piston rod, said piston rod being movably encased in a piston cylinder, an uncoupler actuator attached adjacent to an uncoupling bar engaging end of said braking lever, said uncoupler actuator having a leading edge spaced inwardly from said bar engaging end with an opening therebetween defining an engaging area for receiving said braking pivot pin therein, said uncoupling bar engaging end and said uncoupler actuator wedging said pivot pin in a non-rotatable condition when said braking lever is in engagement with said uncoupling bar.

16. The carrier and braking assembly of claim 15, said uncoupling bar being an elongated bar horizontally mounted perpendicular to movement of said carrier.

17. The carrier and braking assembly of claim 15, said braking lever being of L-shaped configuration with a short leg defining said uncoupling bar engaging end of said braking lever and a long leg attached to said piston rod.

* * * * *

UNITED STATES PATENT AND TRADEMARK OFFICE

CERTIFICATE OF CORRECTION

PATENT NO. : 6,378,440 B1
DATED : April 30, 2002
INVENTOR(S) : Arthur B. Rhodes

It is certified that error appears in the above-identified patent and that said Letters Patent is hereby corrected as shown below:

Column 3,
Line 23, change "and BC" to -- and 8C --.

Signed and Sealed this

First Day of April, 2003

JAMES E. ROGAN
*Director of the United States Patent and Trademark Office*